United States Patent [19]

Garcia

[11] Patent Number: 4,515,370

[45] Date of Patent: May 7, 1985

[54] BOARD GAME

[76] Inventor: Manuel E. Garcia, 3431 Walnut Bend La. #2402, Houston, Tex. 77042

[21] Appl. No.: 505,415

[22] Filed: Jun. 16, 1983

Related U.S. Application Data

[63] Continuation-in-part of Ser. No. 269,485, Jun. 2, 1981, abandoned.

[51] Int. Cl.[3] ..... A63F 3/00

[52] U.S. Cl. ..... 273/258; 273/288; 273/261

[58] Field of Search ..... 273/242, 258, 260, 261, 273/288, 290

[56] References Cited

U.S. PATENT DOCUMENTS

| | | | |
|---|---|---|---|
| 1,116,650 | 11/1914 | Waindle | 273/258 |
| 2,199,719 | 5/1948 | Brothers | 273/242 X |
| 2,296,623 | 9/1942 | Alboska | 273/288 X |
| 2,571,195 | 10/1951 | Buck | 273/288 |
| 2,750,193 | 6/1956 | Wales | 273/258 X |
| 3,680,865 | 8/1972 | Davis | 273/260 |
| 3,751,039 | 8/1973 | Dykoski | 273/260 |
| 3,887,190 | 6/1975 | Ameri | 273/264 |
| 4,211,420 | 7/1980 | Quiroz | 273/260 |
| 4,213,615 | 7/1980 | Price | 273/260 |

FOREIGN PATENT DOCUMENTS

| | | | |
|---|---|---|---|
| 14481 | 8/1881 | Fed. Rep. of Germany | 273/261 |
| 1516069 | 6/1978 | United Kingdom | 273/242 |

*Primary Examiner*—Richard C. Pinkham
*Assistant Examiner*—Scott L. Brown
*Attorney, Agent, or Firm*—Carwell & Helmreich

[57] ABSTRACT

A board game comprising a board having a first and second plurality of triangular areas and a plurality of opposing sets of playing pieces movable on the board. Each playing piece has at least two substantially flat sides so that it may be moved or flipped from one triangular area to another triangular area. When two playing pieces from the same set are positioned in adjacent triangular areas, they may unite to form a single, larger playing piece. The size of the game board may be varied to accommodate different numbers of players by adding or removing player set up areas or strategy areas or by folding unused portions of the board underneath the portion of the board to be used.

19 Claims, 9 Drawing Figures

H
16
15
13
I
G
J 44A
29
28
27
25
26
31
30
47A
32
45A
46A

BOARD GAME

The application is a continuation of U.S. Pat. No. 269,485, filed June 2, 1981, now abandoned.

BACKGROUND OF THE INVENTION

The present invention relates to games of amusement and, in particular, to board games of the type which can be played by two or more people, including a board with a plurality of triangular areas and pieces which can be moved about on the triangular areas.

There have been heretofore proposed numerous types of board games in which pieces are moved about playing areas on a board. Games such as checkers have simplistic rules and identical pieces and thus are easy to learn and relatively inexpensive to manufacture. However, games such as checkers do not involve as high a level of skill and strategy which many people desire. Board games such as chess offer higher levels of skill and strategy, but have numerous different pieces with different rules of movement for each, and thus are more expensive to manufacture and more difficult to learn. Many board games including checkers and chess are not suitable for play by more than two players unless the rules are substantially changed, often resulting in confusion. Indeed, many board games cannot even be played by more than two players.

The disadvantages of the prior art are overcome by the present invention, however, and a novel board game is provided.

SUMMARY OF THE INVENTION

A board game comprising a board having a plurality of parallelogram playing areas divided into triangular sub-areas and a plurality of sets of opposing playing pieces movable on the board. The game board has a plurality of first and a plurality of second triangular position areas arranged on the board. Each of the first and second triangular areas has its sides parallel to corresponding sides of other first and second triangular areas, respectively. Each of the first triangular areas has two or more adjoining or touching first triangular areas, but all triangular areas which have a common side with, and are thus adjacent to, a first triangular area are second triangular areas. Similarly, each of the second triangular areas has two or more adjoining (touching) second triangular areas, but only first triangular areas have a common side with, and are thus adjacent to, a second triangular area.

Each of the playing pieces has at least two substantially flat sides and is linearly movable in a plurality of directions from a first or second triangular area to another first or second triangular area, respectively. Each of the playing pieces is also movable from a first triangular area to an adjoining second triangular area; such move may be a flip of the playing piece from one of its flat sides onto another flat side.

In a preferred embodiment, the size of the game board may be varied to accommodate different numbers of players by adding or removing player set up areas or strategy areas, or by folding unused portions of the board underneath the portion to be used.

Also in a preferred embodiment, two playing pieces from the same set unite to form a single playing piece when these two playing pieces are positioned in adjacent triangular areas. The resulting larger united playing piece has a base which is a parallelogram.

Accordingly, it is a feature of the present invention to provide a novel board game involving a high level of skill and strategy, and which uses inexpensive components.

It is yet another feature of the present invention to provide a board game comprising a board having triangular areas and playing pieces which may be moved or flipped from one triangular area to another triangular area.

It is yet another feature of the present invention to provide a board game wherein two playing pieces from the same set unite to form an adjacent larger, single playing piece.

It is another feature of the present invention to provide a board game wherein the size of the game board may be varied to accommodate different numbers of players.

These and other features and advantages of the present invention will become apparent from the following detailed description wherein reference is made to the figures in the accompanying drawings.

IN THE DRAWINGS

DETAILED DESCRIPTION

Figure 1:
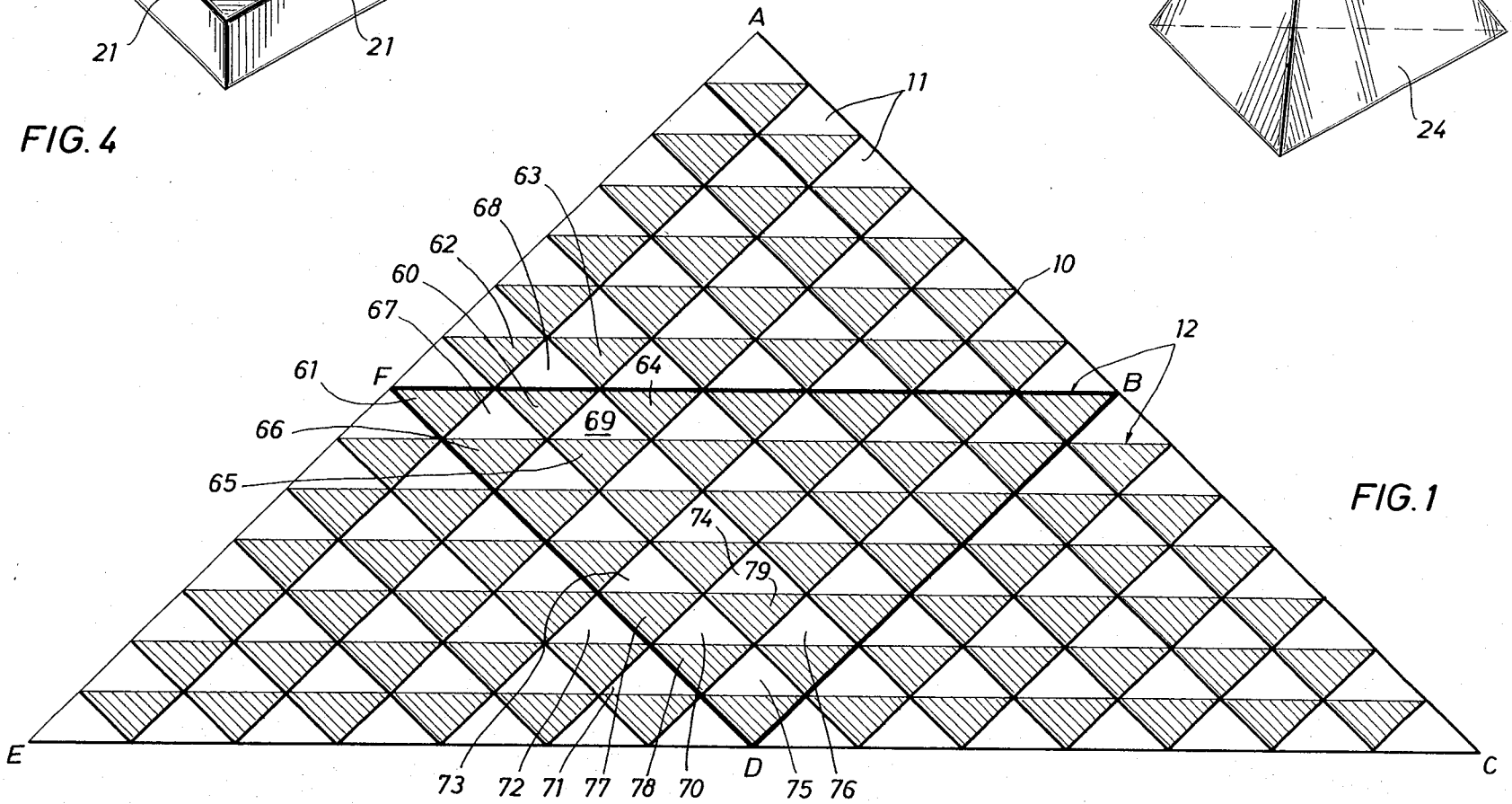
FIG. 1 is a top plan view of an embodiment of a game board according to the present invention.
Figure 2:
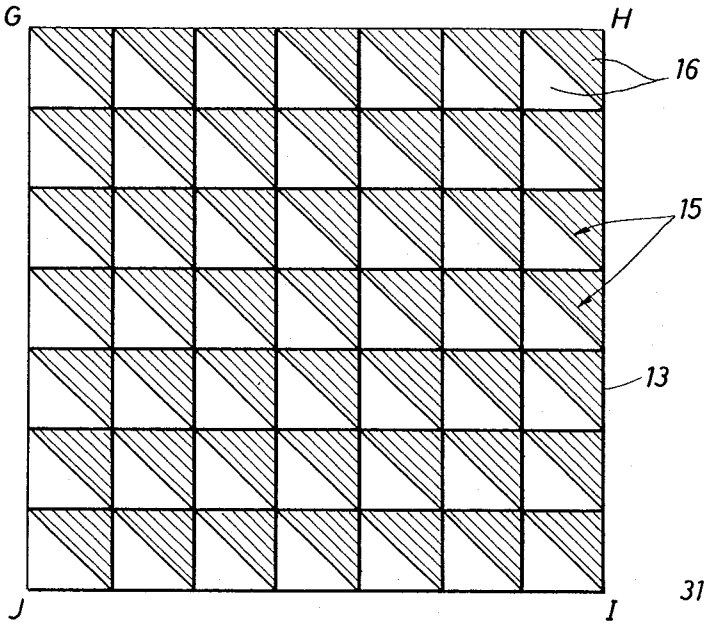
FIGS. 2 and 3 are each top plan views of other embodiments of game boards according to the present invention.
Figure 3:
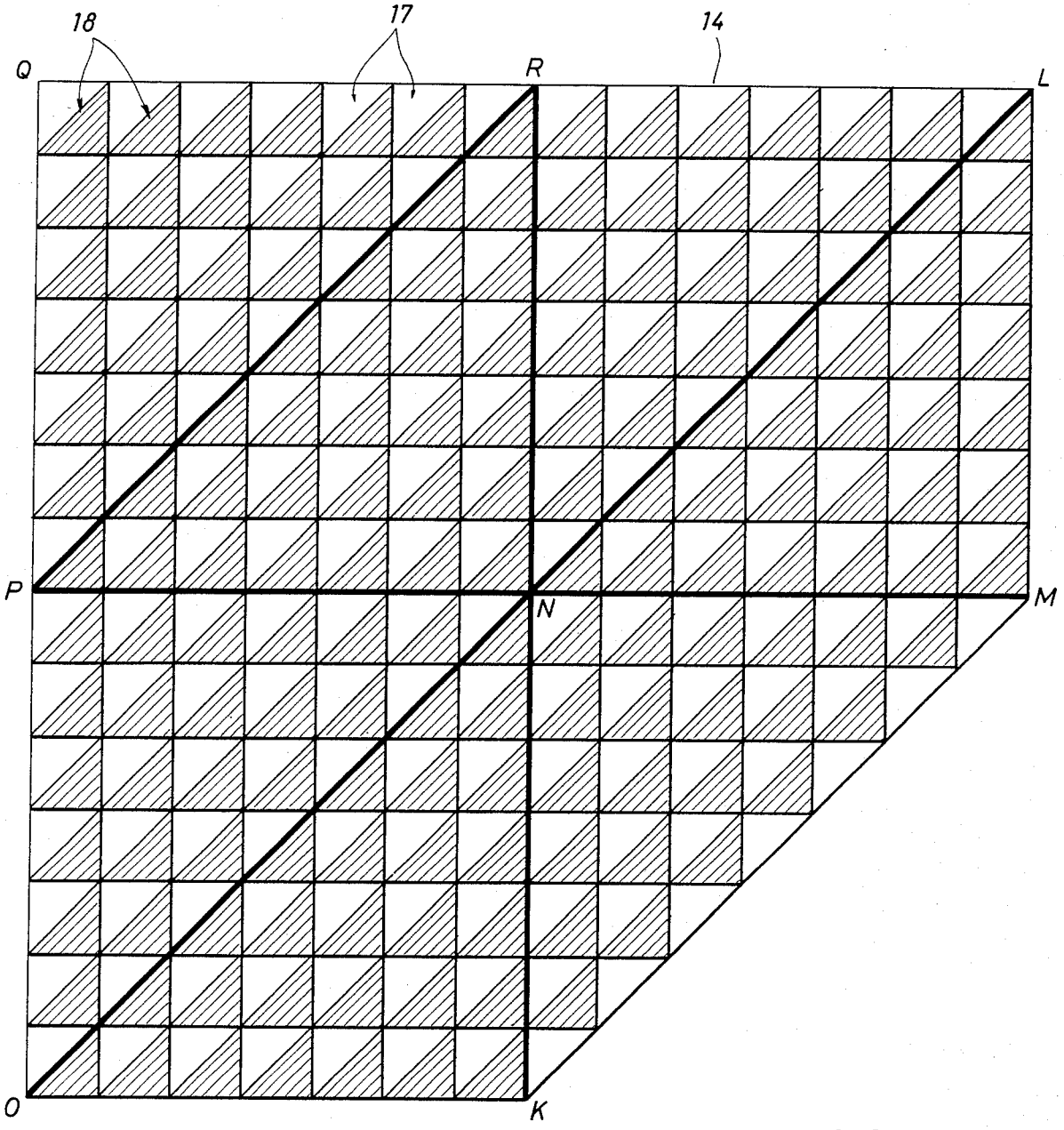

A board game according to the present invention comprises a board formed of any suitable material such as cardboard. FIGS. 1, 2 and 3 depict various configurations for a board according to the present invention.

Referring now to FIG. 1, board 10 is divided into triangular position areas 11. Triangular areas 11 are preferably arranged in diagonal rows. Triangular areas 11 may be isosceles triangles, isosceles right triangles, equilateral triangles, or triangles of other shapes. Game board 10 may be viewed as a plurality of playing areas 12 shaped like parallelograms, each playing area divided into two or more triangular areas. Triangular areas 11 may be of different colors to indicate different set up areas, different strategy areas, or different triangular areas within the same playing area.

Triangular areas 11 belong either to a first plurality of triangular areas or a second plurality of triangular areas. In FIG. 1, the first plurality may be all shaded traingular areas while the unshaded triangular areas may belong to the second plurality. It may be seen from FIG. 1 that each of the first or shaded triangular areas has its sides parallel to the corresponding sides of other first triangular areas. Similarly, each of the second or unshaded triangular areas has its sides parallel to the corresponding sides of other second triangular areas. In addition, each of the first triangular areas has two or more first triangular areas adjoining or touching it, but adjacent (i.e. those sharing a common side) triangular areas are second triangular areas. Referring again to FIG. 1, first triangular area 60 has first triangular areas 61 through 66 adjoining it, but second triangular areas 67, 68 and 69 are adjacent to first triangular area 60. Similarly, second triangular area 70 has second triangular areas 71 through 76 adjoining it, but first triangular areas 77, 78 and 79 adjacent to it.

A set up area is that portion of the board in which a player initially sets up his playing pieces at the beginning of a game. For example, FIG. 1 depicts set up areas ABF, BCD, and DEF. A strategy area, on the other hand is generally located in the center of the board and is used in part to form parallelograms by uniting two playing pieces as will be discussed below. In FIG. 1, for example, the area defined by points BDF is considered the strategy area. The united parallelogram pieces may be formed in any area of the game board; thus in FIG. 1, the parallelogram pieces may be formed in set up areas ABF, BCD and DEF. Strategy areas also become important in determining who wins the game, as will be discussed below.

Different sizes and shapes of boards may be used depending upon the number of players. The size of the board is dependent upon the number of strategy areas and player set up areas. For example, it may be seen that board 13 of FIG. 2 can be formed from board 10 of FIG. 1 by removing from FIG. 1 the set up areas defined by points BCD and DEF. Similarly, board 14 of FIG. 3 can be formed from board 10 of FIG. 1 by adding areas defined by points LMN, MKN, and NKO. Board 13 of FIG. 2 can be formed from board 14 of FIG. 3 by removing the appropriate set up and strategy areas.

Another method of varying the size of the game boards is by folding portions of the board underneath in order to get a smaller board. Thus, board 13 of FIG. 2 can be formed from board 10 of FIG. 1 by folding underneath set up areas BCD and DEF. Similarly, board 10 of FIG. 1 can be formed from board 14 of FIG. 3 by folding underneath board 14 areas defined by points LMN, MKN and NKO. Board 13 of FIG. 2 can be formed from either board 10 of FIG. 1 or board 14 of FIG. 3 by folding appropriate areas underneath the respective boards.

Referring now to FIG. 1, it is seen that board 10 is an isosceles right triangle comprised of four sections, each of which is also an isosceles right triangle. These sections are defined by points ABF, BCD, BDF, and DEF. Within each of these sections there are 49 triangular areas or 21 squares and 7 triangular areas along the edge of a section. Board 10 in FIG. 1 is suitable for use by two and preferably three players, where the area defined by points BDF is a strategy area and the areas defined by points ABF, BCD, and DEF are set up areas. Board 10 is suitable for use by two players if no pieces are set up on one of the three set up areas listed above.

Board 10 need not be an isosceles right triangle, nor need triangles 11 be isosceles right triangles. Triangular areas 11 may be of various shapes, and may have rounded vertices. Similarly, playing areas 12 need not be squares as depicted in FIGS. 1–3, but may take on the shape of any type of parallelogram. Although playing areas 12 are depicted in FIG. 1 as being divided into two triangular areas, it is within the scope of this invention to divide playing areas 12 into three or more triangular areas.

Referring now to FIG. 2, game board 13 is depicted as being a square board containing 56 square playing areas 15, each of which is divided into two triangular areas 16. Board 13 of FIG. 2 is suitable for use by two players, with the areas defined by GHI and GIJ, generally being player set up areas. The embodiment in FIG. 2 does not, therefore, have a separate strategy area. It may be desirable to leave a number of squares 15 unoccupied at the beginning of the game in order to provide more freedom of movement for the playing pieces.

Referring now to FIG. 3, board 14 is suitable for use by two to four players. Board 14 is generally divided into seven sections, each of which is an isosceles right triangle. These sections are the areas defined by points LMN, MKN, NKO, NOP, RPQ, RNP and LNR. Each section has 49 triangular areas 17 or 21 squares 18, and, in addition, 7 triangular areas along an edge of each section. As with boards 10 and 13 depicted in FIGS. 1 and 2, respectively, it is not essential that triangular areas 17 be isosceles right triangles or that playing areas 18 be squares. If there are four players using board 14, areas LNR, MKN, NOP and RPQ may be player set up areas while areas LNM, NKO and RNP may be strategy areas. If area RPQ is removed or folded underneath board 14, then a three player board is formed wherein areas LNR, MKN and NOP are player set up areas, while areas LMN, NKO and RNP are strategy areas.

Figure 4:
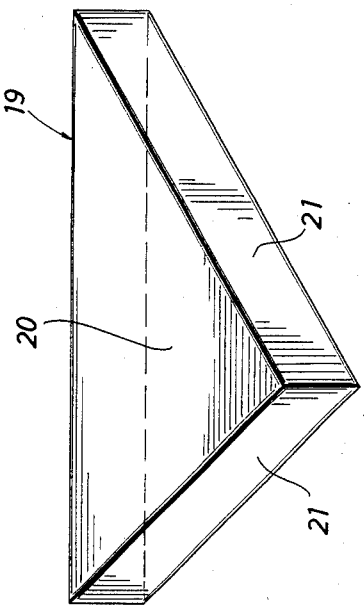
FIG. 4 is a perspective view of a playing piece having two flat triangular sides.

The board game according to the present invention is played with a plurality of sets of playing pieces, one set for each player. The playing pieces can be of numerous shapes and sizes as long as each piece has two substantially flat sides. For example, FIG. 4 depicts piece 19 which is a prism with a triangular side 20 and sides 21. Each playing piece may be substantially two dimensional, i.e. flat.

Figure 5:
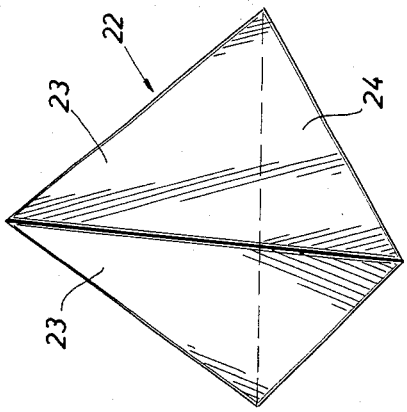
FIG. 5 is a perspective view of a playing piece having the shape of a pyramid with a triangular base.

FIG. 5 depicts another possible shape for playing piece 22. Playing piece 22 is a pyramid with sides 23 and a triangular base 24. Bases 20 and 24 of respective playing pieces 19 and 22 may be isosceles right triangles, equilateral triangles, or other types of triangles. It may be desirable to design the playing pieces so that at least two of its flat sides substantially conform to the shape of any one of said first and second triangular areas. However, the playing pieces need not have triangular sides at all, but may have circular or rectangular sides.

Pieces belonging to the same set may be identical. Pieces of different sets may be differentiated based on different colors or different patterns.

Figure 6:
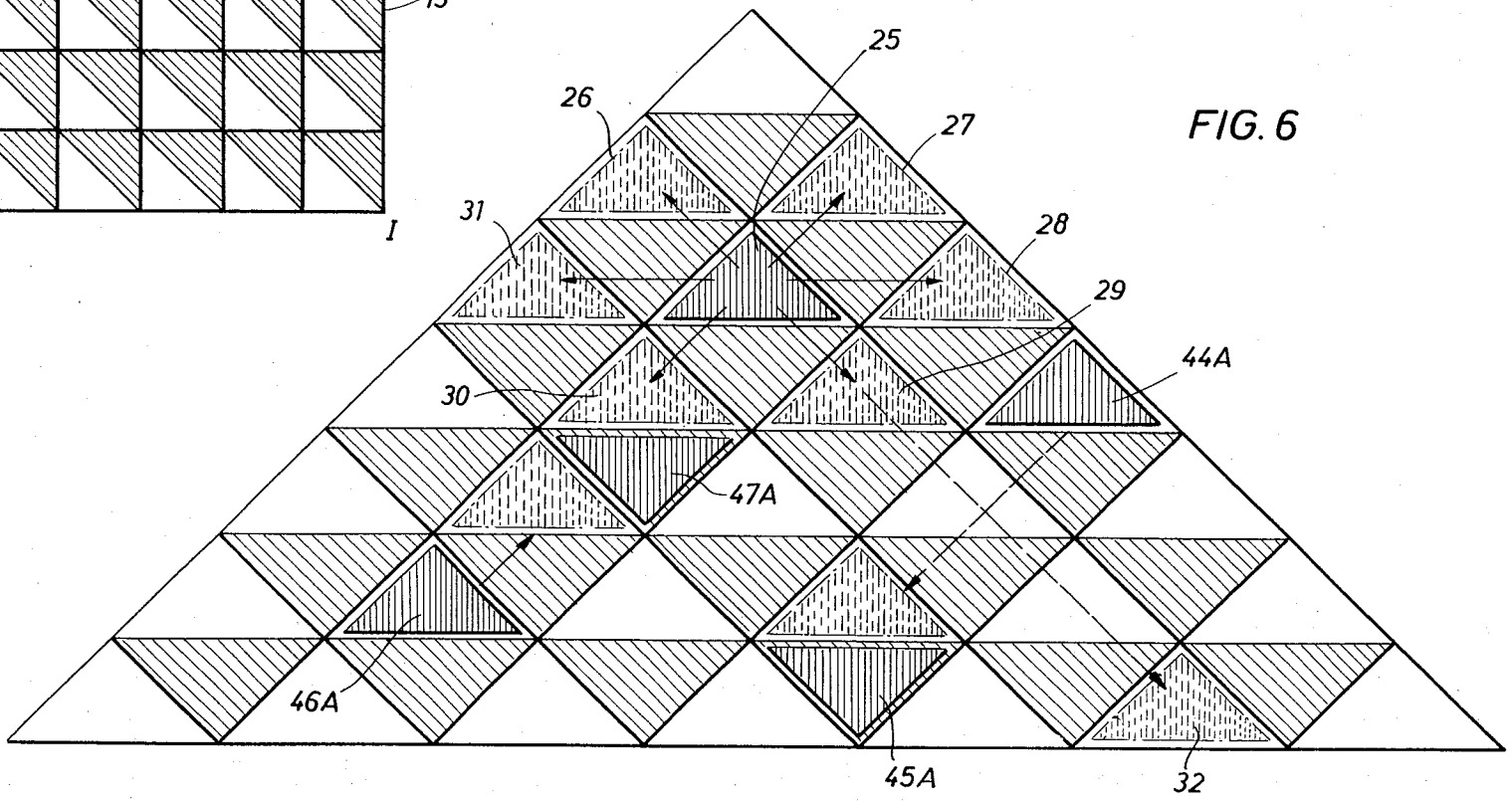
FIG. 6 is a perspective view of a portion of the game board of FIGS. 1-3 depicting movement of playing pieces.

The playing pieces can move in a number of ways. Referring now to FIG. 6, playing piece 25 can generally move linearly in a plurality of directions from a first triangular area to another first triangular area. Thus, playing piece 25 may move to triangular areas 26, 27, 28, 29, 30 and 31. Piece 25 may also move to triangular area 32 if there are no other pieces between the initial triangular area and area 32. Thus, piece 25 may be moved to triangular spaces in any of six proper directions. Similarly, a playing piece positioned on a second triangular area may linearly move to another second triangular area in a plurality of directions.

The playing pieces can also be moved from a first triangular area to a second triangular area or visa versa.

Figure 7:
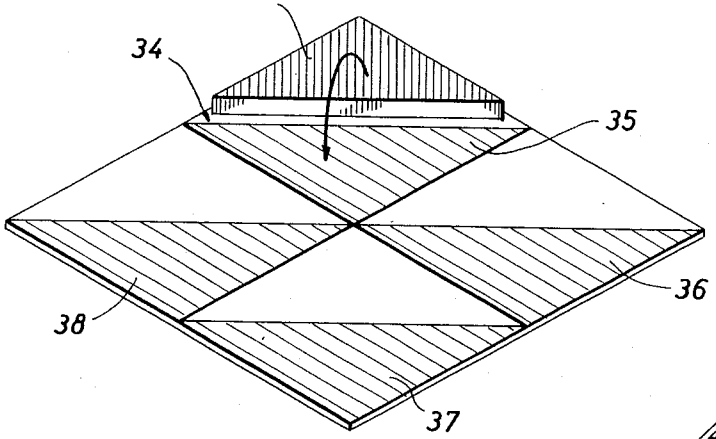
FIG. 7 is a perspective view of a portion of the game board of FIGS. 1-3 depicting a flip of a playing piece inside its own playing area.

Such moves may be a flip of a playing piece from one of its flat sides onto another flat side. FIG. 7 depicts piece 33 being flipped within its same playing area, the latter depicted as the square 34. When it is a given player's turn to move, he may elect to flip a piece within the same playing area as depicted in FIG. 7. Such flips allow a playing piece to move to triangular areas which would be otherwise unavailable if a piece could not flip. That is, once piece 33 has been flipped to triangular area 35, it may thereafter be repositioned in either triangular area 36 or 38, to which it could not have been repositioned had it not been flipped. A flip also allows a piece to escape capture, or to unite with another piece, as will be discussed below.

Figure 8:
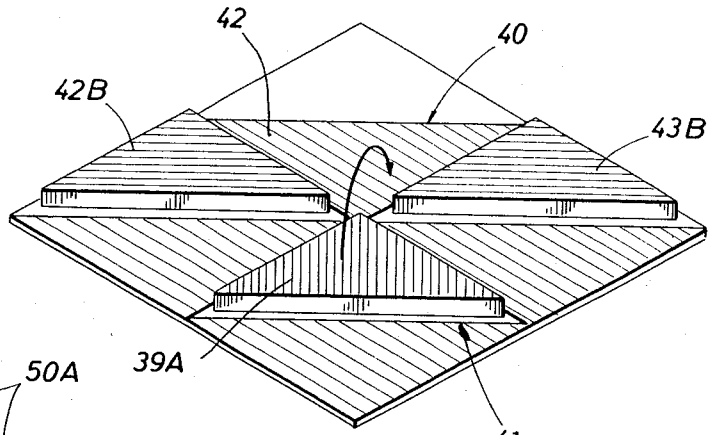
FIG. 8 is a perspective view of a portion of the game board of FIGS. 1-3 depicting a flip of a playing piece outside its own playing area and over two opposing pieces.

FIG. 8 depicts another type of flip, this flip being made by a piece 39A from one playing area to a triangular area 40 outside rectangular playing area 41 in which piece 39A had previously been positioned. The purposes of this "butterfly" flip are similar to the purposes of a flip within the same playing area. In addition, a further purpose is to flip one player's piece over the otherwise blocking pieces of his opponent. Thus, as depicted in FIG. 8, piece 39A, belonging to player A, can be flipped outside of its playing area into triangular area 42 to overcome the obstruction caused by the location of player B's pieces 42B and 43B. If piece 39A is a pyramid, it may be flipped and thus repositioned with one of its sides now becoming the base.

In a preferred embodiment, two pieces from the same set may unite to form a single larger playing piece when they are positioned in adjacent triangular areas. The larger, united playing piece will be linearly movable independent of other playing pieces. Referring now to FIG. 6, it may be seen that if playing piece 44A is repositioned in the same playing area as piece 45A so as to be adjacent thereto, a single playing piece with a base generally shaped like a square may be formed. Of course, if playing pieces 44A and 45A are not isosceles right triangles as depicted in FIG. 6, the resulting single playing piece may have a base shaped like a parallelogram or a rectangle.

There is yet another way to form a single playing piece from two distinct playing pieces belonging to the same set. Again referring to FIG. 6, it may be seen that if piece 46A is repositioned adjacent to, but outside the same playing area of, playing piece 47A, a single playing piece may be formed which has a base shaped like a rhombus or rhomboid. If playing pieces 44A, 45A, 46A, and 47A are pyramids, it may be desirable to flip the resulting pieces onto one of their other sides and thus make those sides the new bases.

As depicted in FIG. 6, the single piece which results from pieces 44A and 45A being positioned in adjacent triangular areas within the same playing area is of a different shape than the single playing piece resulting from the positioning of pieces 46A and 47A in adjacent triangular areas which are not part of the same playing area. Nevertheless, it is within the scope of the present invention to design a game board or playing pieces such that the configurations of these two types of resulting single pieces will be essentially the same.

To aid in the formation of a single playing piece from two pieces of the same set, it may be desirable to design the playing pieces with a means for attaching them to other playing pieces. One such means may be the placing of magnetic strips or magnetic tabs on the sides of the pieces. Another means may be the placing of strips of a fabric fastener, such as Velcro, on the side of the playing pieces. Other attachment means may similarly be used.

If the rules of a particular embodiment of this invention allow the formation of a single larger playing piece from two distinct playing pieces, it may be desirable to devise different rules for the movement of such resulting single pieces. For example, if the rules of the embodiment allow the formation of a single piece from two pieces within the same playing area, it may be desirable to limit the movement of the resulting piece to directions parallel to a side of the single playing piece. Similar rules can be made regarding the movement of the single piece formed from two distinct pieces placed in adjacent triangular areas not within the same playing area. In addition, it may be desirable to allow either type of resulting single piece to split into its two distinct parts whenever its respective player chooses.

Embodiments of the present invention corresponding to different levels of skill may be devised by allowing or disallowing different types of resulting single pieces from being formed. For example, the formation of a resulting single piece from two distinct pieces not within the same playing area may be disallowed for embodiments of low skill levels but allowed for embodiments of higher skill levels.

Beginning of Game

Figure 9:
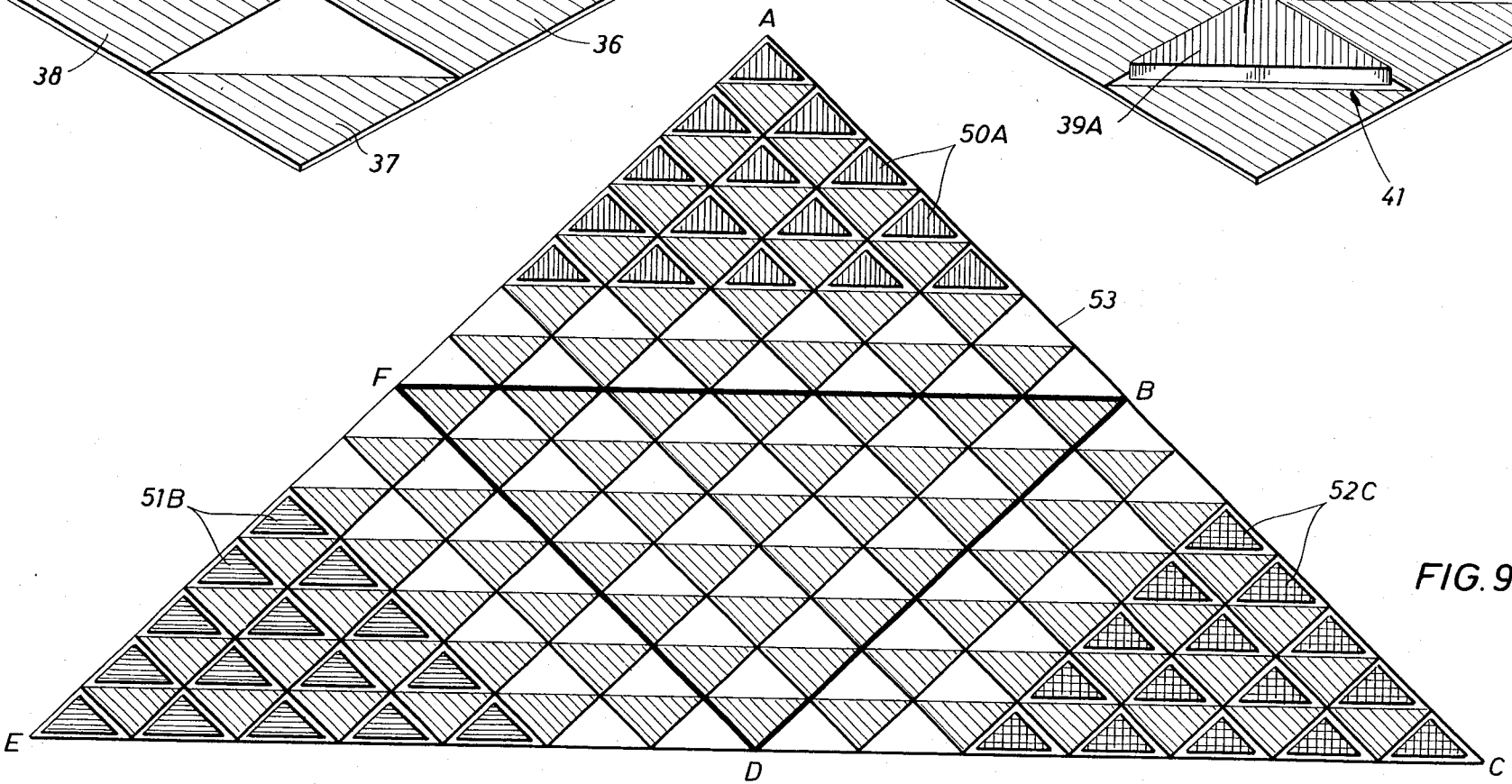
FIG. 9 is a top plan view of the game board of FIG. 1 depicting three sets of pieces set up for the beginning of a game.

FIG. 9 depicts the playing pieces as set up before a three player game. As may be seen from FIG. 9, fifteen pieces 58 belonging to the first player are initially placed in set up area defined by points ABF. Fifteen pieces 51B belonging to a second player are set up in triangular areas found in set up area DEF. Similarly, fifteen pieces 52C belonging to a third player are initially set up in set up area defined by points BCD. The number of pieces of each player may be varied, depending upon the size of the board, the desired length of the game, and other factors.

As the game progresses, parties move their respective pieces into the strategy area generally defined by points BDF. When in the strategy area, a party may capture an opponent's piece by landing within the same playing area or by landing in a playing area which is adjacent to a playing area occupied by an opponent. When a piece is captured, it is removed from game board 53. A party may also capture an opponent's piece in any area of the gameboard. If the gameboard as depicted in FIG. 1 is used, pieces may be captured in player set up areas ABF, BCD and DEF, as well as in strategy area BDF.

If a single piece may be formed by uniting two distinct pieces, special capture rules may be designed. For example, one such rule may be that pieces formed within a single playing area may only capture other pieces which have been similarly formed. Similarly, a rule may be designed so that a single piece formed from adjacent pieces in different playing areas may only capture similar pieces.

A major purpose of the strategy area is to form single pieces or playing members from two distinct, adjacent playing pieces. An object of the game is to form the largest number of such playing members before the game ends. In a two-player game using a board like board 13 of FIG. 2, such single pieces are formed in the opponent's set up area. Where a board is formed similar to board 10 depicted in FIG. 1 or board 14 depicted in FIG. 3, such single pieces may only be formed in the strategy areas. Under one set of rules, the player with the most such resulting single pieces in the strategy area (or in his opponent's set up area for the two player game) at the end of the game is declared the winner. Under different rules, varying amounts of points are credited for different types of playing pieces. When the game ends, the points are tabulated and the person with the most points is declared the winner.

Thus, it may be seen that the person with the most non-joined, triangular based pieces is not necessarily the winner, since the person with the most joined pieces is the winner at the end of the game. Also, it may be seen that it is not necessarily beneficial to do a lot of capturing; a preferred strategy may be to attempt to form as many such united pieces as possible.

End of Game

The two player game played on board 13 as depicted in FIG. 2 ends when the last piece of either player is moved into his opponent's section, or when 7 the last piece of a single opponent is captured. In other words, the game ends when all of a player's pieces have left his own set up area.

When the board being used has a different configuration, i.e., one with a strategy area, the game ends when all of the pieces of one player are within the strategy area or when one player loses all of his pieces by having them captured. Different rules can be devised for determining both when the game ends and which player wins the game.

It is therefore apparent that the present invention is one well adapted to attain all of the objects and advantages hereinabove set forth together with other advantages which will become obvious and inherent from the description of the board game itself. It will be understood that certain combinations and subcombinations are of utility and may be obtained without reference to other features and subcombinations. This is contemplated by and is within the scope of the present invention.

What is claimed is:

1. A method of playing a board game including opposing sets of triangular-shaped pieces and a game board having a plurality of first and a plurality of second triangular areas arranged on said board, with each of said first triangular areas having its sides parallel to corresponding sides of other of said first triangular areas, each of said second triangular areas having its sides parallel to corresponding sides of other of said second triangular areas, each of said first triangular areas having two or more adjacent first triangular areas and having one or more adjacent second triangular areas, and each of said second triangular areas having two or more adjacent second triangular reas and having one or more adjacent first triangular areas, said method comprising:

linearly moving a selected one of said playing pieces in a selected direction from one of said first triangular areas to another of said first triangular areas;

linearly moving a selected one of said playing pieces in a selected direction from one of said second triangular areas to another of said second triangular areas;

rotatably moving a selected one of said playing pieces about an axis substantially parallel with one of its sides from one of said first triangular areas to an adjoining second triangular area;

rotatably moving a selected one of said playing pieces about an axis parallel with one of its sides from one of said second triangular areas to an adjoining first triangular area;

one of said first triangular areas and an adjacent one of said second triangular areas forming a parallelogram area;

selectively positioning two playing pieces from the same set in adjacent triangular areas for forming a united parallelogram-shaped playing member; and linearly moving said united parallelogram-shaped playing member independntly of said other playing pieces from one parallelogram area to another parallelogram area.

2. A method as defined in claim 1, further comprising:

each of said plurality of first and plurality of second triangular areas being a right isosceles triangular area; and rotatably moving a selected one of said playing pieces about an axis substantially parallel with its side opposite its right angle and passing through the apex of said right angle from one of said first triangular areas to an adjoining one of said second triangular areas.

3. A method as defined in claim 1, further comprising:

moving said playing pieces from set-up areas adjacent the perimeter of said game board to a strategy area generally toward the center of said game board; and capturing opposing triangular playing pieces by moving a triangular playing piece from one set adjacent a triangular playing piece from an opposing set.

4. A method as defined in claim 3, further comprising:

terminaing playing said board game as a function of when each playing piece from one set of playing pieces is moved out of its respective set-up area.

5. A method of playing a board game including opposing sets of triangular-shaped playing pieces and a game board having a plurality of first and a plurality of second triangular areas arranged on said board, with each of said fist triangular areas having its sides parallel to corresponding sides of other of said first triangular areas, each of said second triangular areas having its sides parallel to corresponding sides of other of said second triangular areas, each of said first triangular areas having two or more adjacent first triangular areas and having one or more adjacent second triangular areas, and each of said second triangular areas. having two or more adjacent second triangular areas and having one of more adjacent first triangular areas, said method comprising:

linearly moving a selected one of said playing pieces in a selected direction from one of said first triangular areas to another of said first triangular areas;

linearly moving a selected one of said playing pieces in a selected direction from one of said second triangular areas to another of said second triangular areas;

positioning two of said playing pieces from the same set in adjacent triangular areas for forming a parallelogram-shaped united playing member; and linearly moving said parallelogram-shaped united playing member independently of said other playing pieces.

6. A method as fined in claim 5, further comprising:

temporarily securing one playing piece with another playing piece from the same set to form said parallelogram-shaped playing member.

7. A method as defined in claim 5, wherein each of said plurality of first and plurality of second triangular areas are isosceles right triangular areas, and said parallelogram-shaped united playing member is a square-shaped united playing member.

8. A method as defined in claim 7, further comprising:

rotatably moving a selected one of said playing pieces about an axis substantially aligned with its side opposite its right angle from one of said first triangular areas to an adjacent one of said second triangular areas.

9. A method as defined in claim 7, further comprising:

rotatably moving a selected one of said playing pieces about an axis substantially parallel with its side opposite its right angle and passing through the apex of said right angle from one of said first triangular areas to an adjoining one of said second triangular areas.

10. A method as defined in claim 7, further comprising:

moving said playing pieces from set-up areas adjacent the perimeter of said game board to a strategy area generally toward the center of said game board; and capturing opposing triangular playing pieces by moving a triangular playing piece from one set adjacent a triangular playing piece from an opposing set.

11. A method as defined in claim 5, further comprising:

moving said playing pieces from set-up areas adjacent the perimeter of said game board to a strategy area generally toward the center of said game board; and capturing opposing parallelogram-shaped united playing members by moving a parallelogram-shaped united playing member from one set adjacent a parallelogram-shaped united playing member from an opposing set.

12. A method as defined in claim 5, further comprising:

moving open of said playing pieces forming said united playing member while leaving the other of said playing pieces forming said united playing member for forming two separately positionable playing pieces.

13. A method as defined in claim 5, wherein each of said plurality of first and plurality of second triangular areas are isosceles right triangular areas, and said parallelogram-shaped united playing member is a rhomboid-shaped united playing member.

14. A method as defined in claim 5, wherein each of said laying pieces are linearly movable a selected distance in a selected direction from one triangular area to another triangular area.

15. The method of playing a board game including opposing sets of triangular-shaped playing pieces in a game board having a plurality of first and a plurality of second adjacent right isosceles triangular areas arranged on said board, said method comprising:

linearly moving a selected one of said playing pieces a selected distance in a selected direction from one of said first triangular areas to another of said first triangular areas;

linearly moving a selected one of said playing pieces a selected distance in a selected direction from one of said econd triangular areas to another of said second triangular areas;

rotatably moving a selected one of said playing pieces about an axis substantially parallel with one of its sides from one of said first triangular areas to an adjoining second triangular area;

rotatably moving a selected one of said playing pieces about an axis substantially parallel with one of its sides from one of said second triangular areas to an adjoining first triangular area;

rotatably moving a selected one of said playing pieces about an axis substantially parallel with its side opposite its right angle and passing through the apex of said right angle from one of said first triangular areas to an adjoining one of said second triangular areas;

rotatably moving a selected one of said playing pieces about an axis substantially parallel with its side opposite its right angle and passing through the apex of said right angle from one of said second triangular areas to an adjoining one of said first triangular areas;

selectively positioning two playing pieces from the same set in adjacent triangular areas for forming a parallelogram-shaped united playing member; and linearly moving said parallelogram-shaped united playing member independently of said other playing pieces.

16. A method as defined in claim 15, wherein said parallelogram-shaped united playing member is a square-shaped united playing member, and said square-shaped united playing member is linearly movable a selected distance independently of said other playing pieces from one area to another square area.

17. A method as defined in claim 15, wherein said parallelogram-shaped united playing member is a rhomboid-shaped united playing member, and said rhomboid-shaped united playing member is linearly movable a selected distance independently of said other playing pieces from one rhombus area to another rhombus area.

18. A method as defined in claim 15, wherein a selected one of said playing pieces may be linearly moved a selected distance in one of six selected directions from one triangular area to another triangular area.

19. A method as defined in claim 15, further comprising:

moving one of said playing pieces forming said parallelogram-shaped united playing member while leaving the other said playing pieces forming said parallelogram-shaped united playing member for forming two separately positionable playing pieces.

* * * * *